US005791248A

United States Patent [19]

Atkins et al.

[11] Patent Number: 5,791,248

[45] Date of Patent: Aug. 11, 1998

[54] LIQUID SUPPLY UNIT FOR ROLL APPLICATOR AND METHOD

[75] Inventors: Mark R. Atkins; Craig T. Compton, both of Green Bay, Wis.

[73] Assignee: Paper Converting Machine Company, Green Bay, Wis.

[21] Appl. No.: 827,388

[22] Filed: Mar. 27, 1997

[51] Int. Cl.[6] ..... B41F 31/02

[52] U.S. Cl. ..... 101/350.6; 101/366; 101/364

[58] Field of Search ..... 101/350.1, 350.6, 101/366, 169, 167, 363, 364

[56] References Cited

U.S. PATENT DOCUMENTS

| | | | |
|---|---|---|---|
| 3,354,823 | 11/1967 | Lake | 101/366 |
| 3,899,999 | 8/1975 | Christ et al. | 101/366 |
| 4,009,657 | 3/1977 | Bonanno et al. | 101/366 |
| 4,945,832 | 8/1990 | Odom | 101/350.6 |
| 5,054,392 | 10/1991 | Greenwood | 101/366 |
| 5,121,689 | 6/1992 | Fadner | 101/366 |
| 5,125,341 | 6/1992 | Yaeso | 101/366 |
| 5,239,925 | 8/1993 | Bobo | 101/366 |
| 5,272,976 | 12/1993 | Reder et al. | 101/366 |
| 5,406,887 | 4/1995 | Hertel et al. | 101/366 |
| 5,497,702 | 3/1996 | Gorter | 101/366 |

FOREIGN PATENT DOCUMENTS

| | | | |
|---|---|---|---|
| 0 047 618 A1 | 3/1982 | European Pat. Off. | 101/169 |

OTHER PUBLICATIONS

"Ghosting"—Progressive Ink 1996.

*Primary Examiner*—Edgar S. Burr
*Assistant Examiner*—Leslie Grohusky

[57] ABSTRACT

A liquid fountain unit and method for a roll applicator equipped with doctor blades extending parallel to the roll axis and an axially extending third blade mounted adjacent one of the doctor blades and having an angled configuration in the fountain unit chamber with a free edge portion directed toward the roll applicator, the third blade being equipped with a passage to permit liquid flow from one blade side to the other to substantially minimize ghosting.

16 Claims, 2 Drawing Sheets

LIQUID SUPPLY UNIT FOR ROLL APPLICATOR AND METHOD

BACKGROUND

This invention relates to metering of a liquid with a blade and engraved roll such as flexographic printing units that use doctor blade-equipped chambers to meter ink on an anilox roll—other advantageous applications being coaters and laminators.

In present systems using doctor chambers, two doctor blades are typically used. One blade is used for doctoring and the other is used for containment (trailing).

The problem with the present art is ghosting. Ghosting as defined by the Foundation of Flexographic Technical Association's *Flexography Principles and Practices*, Fourth Edition: "(1) The appearance of a faint image of the design being printed in areas which are not intended to receive that portion of the image. (2) The appearance of a fainter unwanted image in a printed area caused by local ink starvation on the transfer roll from the previous impression." Another source for an explanation of ghosting is an information sheet of Progressive Ink, Inc. of Shrewsbury, Mo. This disadvantage has been tolerated because there is no simple way of solving this problem. One fairly elaborate proposal is seen in U.S. Pat. No. 5,239,925.

INVENTION

The instant invention utilizes a third blade mounted adjacent to the doctoring or containment blade in a typical two-blade system, i.e., between the two blades of the normal set. This allows the doctor system to accurately and consistently meter the ink being applied to the plate material. As indicated above, there is known one U.S. patent that has added a third doctor blade to the doctor blade holders—U.S. Pat. No. 5,239,925. This has a limitation with respect to installation, cleaning, roll wear, blade wear, and limited use.

To solve the problem of ghosting as well as reduce the setup and cleaning time a third blade is added adjacent to the doctor or containment blade. The third blade is generally located inside the doctor blade chamber between the doctor or containment blade. The third blade improves printing by reducing or eliminating ghosting. The third blade creates high and low pressure areas within a common chamber, resulting in better filling of the anilox cells with ink. This third blade is angled at approximately 64°, although other angles may be used with given conditions. The blade is angled toward the anilox. The gap between this blade and the anilox roll is approximately 1/16 inches. In some wide web applications there are improved results with the blade contacting the roll. The blade has openings along its surface to allow ink to pass through whereby this third blade causes a vortex action with the ink. This, in turn, forces the ink into the cells of the anilox roll, thereby fully replenishing the anilox cells. This gives consistent amounts of ink along the anilox roll.

This novel third blade is advantageously provided in one embodiment in a conventional ink fountain unit such as is shown and described in co-owned U.S. Pat. Nos. 5,125,341 and 5,406,887 and the ensuing specification is phrased in terms of a printing press but it will be appreciated that the other above-listed applications are advantageous.

DETAILED DESCRIPTION OF DRAWING

The invention is described in conjunction with the accompanying drawing, in which FIG. 1 is a side elevational view, essentially schematic, of a flexographic press equipped with the supplemental or third blade of the instant invention;

DETAILED DESCRIPTION

Figure 1:
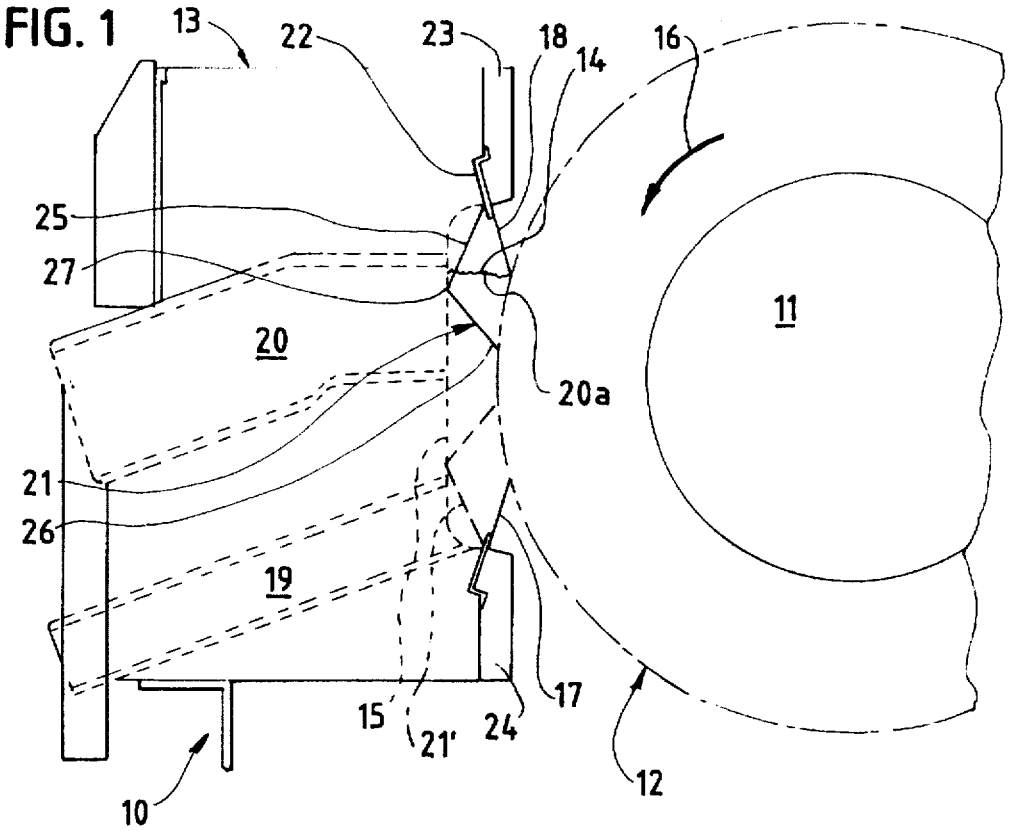

In the illustration given and with reference first to FIG. 1, the numeral 10 generally designates a frame which supports the shaft 11 of an anilox roll generally designated 12. The numeral 13 generally designates a fountain 13 also supported on the frame 10. Many details have been omitted for clarity of understanding and ease of presentation. These can be found, for example, in the above co-owned patents.

Provided in the fountain 13 is a liquid chamber 14 defined by a wall 15 confronting but spaced from the periphery of the anilox roll 12.

When the anilox roll 12 is rotating counterclockwise—see the arrow 16—the lower blade 17 is the doctor while the upper or trailing blade 18 provides the containment function.

Liquid, i.e., ink or the like, is introduced through the lower conduit 19 and recirculated to a pump (not shown) by the upper conduit 20. Normally, the chamber 14 is filled with ink up to the level 20*a*.

Figure 2:
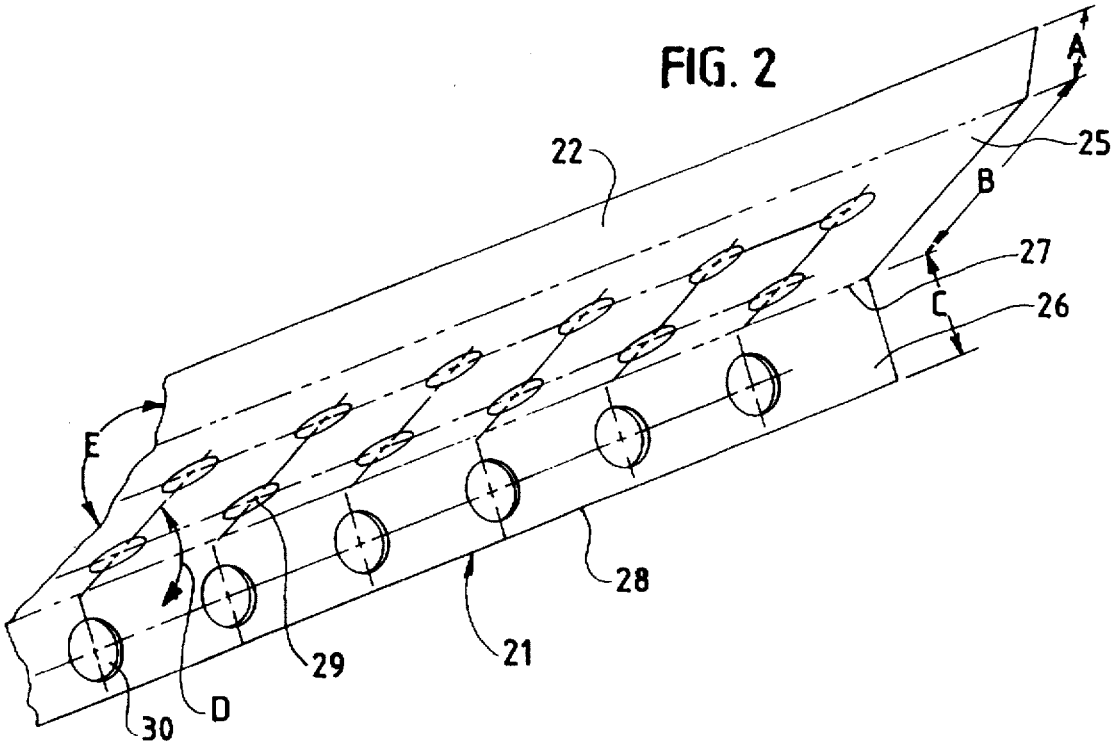
FIG. 2 is a fragmentary perspective view of the inventive third blade which is shown in smaller scale in the central right hand portion of FIG. 1.

The invention is particularly concerned with the third blade generally designated 21 and which is seen in greater detail in FIG. 2. The third blade 21 is seen to include a first portion 22 which is mounted between the trailing blade 18 and the fountain and effectively clamped therebetween by means of the upper clamp 23. A similar clamping is provided for the lower or doctor blade 17—and, if desired, the third blade may be clamped by lower clamp 24 against the fountain 13. We have indicated that location by the dashed line designated 21'.

The third blade is of unitary construction and has an angled configuration within the chamber 14. This angled configuration includes a first angled portion 25 (see also FIG. 2) and a second angled portion 26. As can be readily appreciated from a consideration of FIG. 1, the first angled portion 25 extends toward the wall 15 of the chamber 14, i.e., the wall spaced from the anilox roll 12 and, in the preferred construction, as with the second angled portion 26 provides an angle or corner as at 27 which abuts the wall 15. The angled portion 26 has a free edge portion directed toward the anilox roll.

For relatively narrow web widths, it has been found that there can be a slight gap between the edge 28 of the portion 26 and the anilox roll whereas for relatively wider webs, it is advantageous to have the edge 28 in wiping or bearing engagement with the anilox roll 12. In either event, there is a slight constriction of the flow from one side of the third blade 21 to the other at this point.

Major flow from one side of the third blade to the other is provided via holes or passages 29 in the portion 25 and holes or passages 30 in the portion 26. The flow therethrough—normally vertically as provided by ink or other fluid being supplied by the conduit 19 and recirculated through the conduit 20 performs a scrubbing action by virtue of creating turbulence so as to remove any air that could be captured or trapped within the cell structure of the anilox roll. This has been found to relieve the problem of variation in color intensity in circumferentially extending panels or portions of a web being printed on the press associated with the anilox roll 12.

EXAMPLE

To illustrate the best mode known for practicing the invention with a typical anilox roll having a diameter of about 5.8 to about 7.0 inches, the third blade can be used wherein the dimension A (see FIG. 2) is ½ inch, the dimension B is 2 inches and the dimension C is ¾ inch. The angle D is 30° while the angle E is 150° with the diameter of the openings 29, 30 being ⅛ inches.

Excellent results are obtained where the angle between the portion 26 and the tangent to the anilox roll 12 is of the order of 15° to about 60°.

The blade 21 can be made from the same material typically used for doctor blades. This material is steel, stainless, or plastic. The thickness can vary. Typically the thickness is between about 0.010" to about 0.060" (0.2–1.2 mm.).

Figure 3:
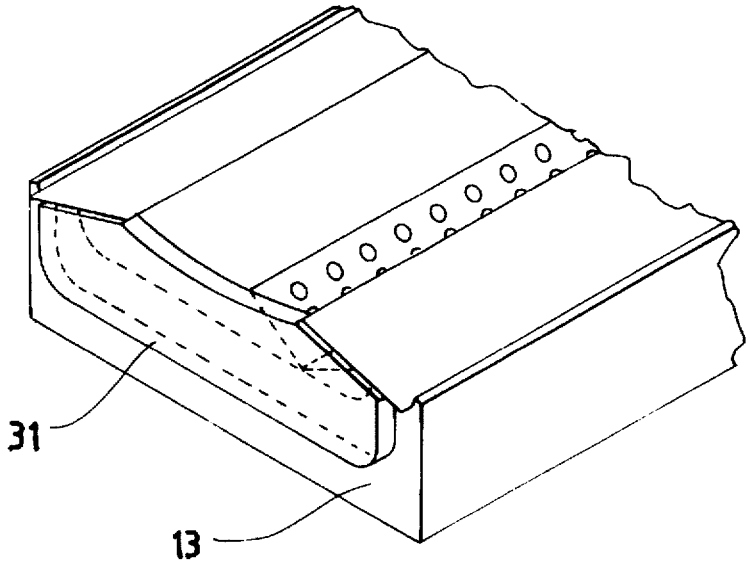
FIG. 3 is a fragmentary perspective view of the ink fountain as viewed from the anilox roll direction.
Figure 4:
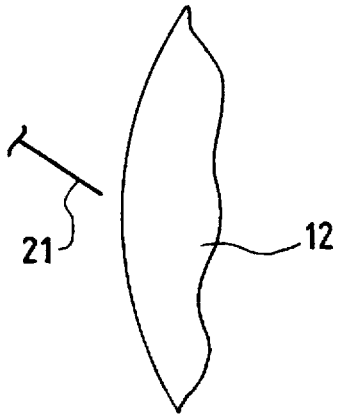
FIG. 4 is a fragmentary perspective view of the anilox roll and the third blade.

Advantageously, the third blade 21 can extend all the way to the end seals, one of which is seen at 31 in FIG. 3. Where the end seal is angled, the inventive blade means can also be conformingly angled. Again, since flow from one side to the other of the blade means is desirable, it is not necessary to develop a fluid-tight seal between the end seals 31 and the blade means 21.

SUMMARY

The problem of ghosting is solved as well as reducing the setup and cleaning time by installing a third blade adjacent to the doctor or containment blade 17, 18, respectively. The third blade is generally located inside the doctor blade chamber 14 between the doctor or containment blade. The third blade creates high and low pressure areas within the chamber 14, resulting in better filling of the anilox cells with ink and by scavenging air from them.

The advantage of the present invention is the addition of the third blade 21 as a baffle. The third blade in this invention also can be readily installed into present design two blade systems. The blade also does not have to contact the rolls. In some wide web applications there are improved results with the blade contacting the roll. This gives longer roll life. Also, the third blade 21 does not wear itself on the roll 12. The present invention also provides easy installation and cleanup.

The invention includes an ink fountain unit as seen in FIG. 1 and is useful in connection with a printing press. The unit includes a frame 10, a relatively elongated, cylindrical, cell-equipped transfer or anilox roll 12 which is rotatably mounted on the frame 10. Provided is a relatively elongated ink fountain 13 mounted on the frame adjacent the roll and parallel thereto. The fountain or blade holder 13 is equipped with ink delivery means as at 19, 20 so as to maintain an ink level 20*a* in the chamber 14 defined between the anilox roll and the holder confronting wall 15.

As illustrated, the fountain 13 is equipped with a top or trailing blade 18, a bottom or doctor blade 17 and end seals as at 31 (see FIG. 3). Each of these seals (including the blades 17, 18) have free edges bearing against the anilox roll to define the closed chamber 14.

The invention includes a third blade 21 in the chamber 14 mounted between the blades 17, 18 and having an angled configuration 25, 26 in the chamber 14. The blade 21 also has a free edge portion in the form of portion 26 directed toward the anilox roll 12 (see particularly FIG. 1). The angled configuration including the portions 25, 26 is equipped with holes as at 29, 30 which permit ink flow through the blade 21 to scavenge air from the roll cells.

INVENTIVE METHOD

The inventive method in its broadest aspect includes the steps of installing a third blade in a roll application having a two doctor blade fountain and flowing liquid through the third blade to crate turbulence against the roll. In more detail the method includes the steps of providing a frame, a relatively elongated, cell-equipped cylindrical transfer roll mounted in the frame for rotation about the roll axis, a relatively elongated, axially extending ink fountain mounted on the frame adjacent the roll and parallel thereto, the fountain being equipped with ink delivery means so as to maintain an ink level therein, the fountain being equipped with top, bottom and end seals having free edges bearing against the roll to define a closed chamber for ink, the top and bottom seals being generally planar doctor blades constructed of relatively resilient material, each of the end seals being generally planar and also being constructed of a relatively resilient material so as to continuously flex against the roll, and installing a third blade mounted adjacent one of the blades and having an angled configuration in the chamber with a free edge portion directed toward the roll, the chamber having a vertical wall confronting the roll, the angle of the angled configuration abutting the vertical wall, the third blade having holes therein promoting turbulent flow for scavenging air from the cells to substantially eliminate ghosting.

While in the foregoing specification a detailed description of an embodiment of the invention has been set down for the purpose of illustration, many variations in the details hereingiven may be made by those skilled in the art without departing from the spirit and scope of the invention.

We claim:

1. A roll applicator comprising a frame, a relatively elongated cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid, and a third blade mounted adjacent one of said doctor blades to divide said chamber into two axially-extending parts, said third blade having an angled configuration in said chamber with a free edge portion directed toward said roll, said fountain having a wall confronting said transfer roll and spaced therefrom, said angled configuration defining a corner, said corner bearing against said confronting wall.

2. A roll applicator comprising a frame, a relatively elongated cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid, and a third blade mounted adjacent one of said doctor blades to divide said chamber into two axially-extending parts, said third blade having an angled configuration in said chamber with a free edge portion directed toward said roll, said angled configuration defining a corner, said corner bearing against said chamber.

3. A roll applicator comprising a frame, a relatively elongated cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid, means for mounting the top and bottom doctor blades in said fountain, and a two-sided third blade mounted on the mounting means for one of said doctor blades and adjacent to said one doctor blade to divide said chamber into two axially-extending parts, said third blade being equipped with hole means for permitting liquid flow from one side of said third blade to the other to substantially prevent ghosting.

4. A roll applicator comprising a frame, a relatively elongated cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid, and a two-sided third blade mounted between said doctor blades to divide said chamber into two axially-extending parts, said third blade being equipped with hole means permitting liquid flow from one side of said third blade to the other to substantially prevent ghosting, said third blade having a first portion engageable by said adjacent doctor blade for clamping relation with said fountain, a second portion extending angularly away from said first portion and abutting a wall of said fountain spaced from said transfer roll and a third portion extending angularly away from said second portion and toward said transfer roll.

5. A roll applicator comprising a frame, a relatively elongated cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid, means for mounting the top and bottom doctor blades in said fountain, and a third blade mounted on the mounting means for one of said doctor blades and adjacent to said one doctor blade to divide said chamber into two axially-extending parts, said third blade having an angled configuration in said chamber with a substantially straight free edge portion directed toward said roll.

6. The fountain of claim 5 in which said third blade is equipped with two sides and with means for permitting ink flow from one side to the other.

7. The fountain of claim 6 in which said flow means include holes in said third blade.

8. The fountain of claim 5 in which said delivery means includes an inlet on one side of said third blade and an outlet on the other side.

9. The fountain of claim 5 in which said free edge portion engages said roll.

10. The fountain of claim 5 in which said free edge portion terminates a small distance from said roll.

11. A method of operating a roll applicator comprising the steps of providing a frame, a relatively elongated, cell-equipped cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid and means for mounting the top and bottom doctor blades, mounting a third blade on the mounting means for one of said doctor blades and adjacent to said one doctor blade to divide said chamber into two axially extending parts, said third blade having an angled configuration in said chamber with a substantially straight free edge portion directed to said roll.

12. The method of claim 11 in which said steps include providing openings in said third blade to permit liquid flow from one side thereof to the other.

13. The method of claim 12 in which said steps include introducing liquid into said chamber below said third blade free edge position and withdrawing liquid from said chamber above said free edge portion.

14. The method of claim 12 in which said steps include flowing liquid vertically in said chamber to promote turbulence around said free edge portion to scavenge air from said roll cells.

15. A method of operating a roll applicator comprising the steps of providing a frame, a relatively elongated, cell-equipped cylindrical transfer roll mounted in said frame for rotation about the roll axis, a relatively elongated liquid fountain mounted on said frame adjacent said roll and parallel thereto, said fountain being equipped with liquid delivery means so as to maintain a liquid level therein, said fountain being equipped with top and bottom doctor blades having free edges bearing against said roll to define a chamber for liquid, installing a third blade adjacent one of said doctor blades to divide said chamber into two axially extending parts, said third blade having an angled configuration in said chamber with a free edge portion directed to said roll, said steps including providing openings in said third blade to permit liquid flow from one side thereof to the other, and positioning the angle of said angled configuration against a vertical wall of said chamber.

16. A printing press comprising a frame, a relatively elongated, cell-equipped cylindrical transfer roll mounted in said frame for rotation about the roll axis, a relatively elongated axially extending ink fountain mounted on said frame adjacent said roll and parallel thereto, said fountain being equipped with ink delivery means so as to maintain an ink level therein, said fountain being equipped with top, bottom and end seals having free edges bearing against said roll to define a closed chamber for ink, said top and bottom seals being generally planar doctor blades constructed of relatively resilient material, each of said end seals being generally planar and also being constructed of a relatively resilient material so as to continuously flex against said roll, means for mounting the doctor blades in said fountain, and a third blade mounted on the mounting means for one of said blades and adjacent to said one doctor blade and having an angled configuration in said chamber with a free edge portion directed toward said roll, said chamber having a vertical wall confronting said roll, the angle of said angled configuration abutting said vertical wall, said third blade having holes therein for promoting turbulent flow for scavenging air from said cells to substantially eliminate ghosting.

* * * * *